US010508008B2

(12) United States Patent
Lane

(10) Patent No.: US 10,508,008 B2
(45) Date of Patent: Dec. 17, 2019

(54) PNEUMATIC JACKING ASSEMBLY

(71) Applicant: Arnold Lane, Baltimore, MD (US)

(72) Inventor: Arnold Lane, Baltimore, MD (US)

( * ) Notice: Subject to any disclaimer, the term of this patent is extended or adjusted under 35 U.S.C. 154(b) by 37 days.

(21) Appl. No.: 15/671,964

(22) Filed: Aug. 8, 2017

(65) Prior Publication Data

US 2019/0047833 A1 Feb. 14, 2019

(51) Int. Cl.
*B66F 3/35* (2006.01)

(52) U.S. Cl.
CPC ..... *B66F 3/35* (2013.01)

(58) Field of Classification Search
USPC ..... 254/89 H, 93 HP, 93 VA
See application file for complete search history.

(56) References Cited

U.S. PATENT DOCUMENTS 2,495,092 A * 1/1950 Cox ..... B66F 3/35 188/154
3,377,610 A * 4/1968 Busch ..... H01R 24/58 337/186
3,380,758 A 4/1968 Granning
3,695,582 A * 10/1972 Clay ..... B66F 3/35 254/93 HP
3,744,756 A 7/1973 Smith
4,560,145 A 12/1985 Widmer
4,948,107 A 8/1990 Orndorff, Jr.
9,056,755 B1 * 6/2015 Moy ..... B66F 3/24
D739,111 S * 9/2015 Arrindell ..... D34/31
9,598,270 B2 * 3/2017 Nielsen ..... B66F 3/35
2008/0149905 A1 * 6/2008 Fernandez ..... B66F 3/35 254/93 HP
2012/0248393 A1 10/2012 Moore et al.

FOREIGN PATENT DOCUMENTS

WO WO2006053374 5/2006

* cited by examiner

*Primary Examiner* — Joseph J Hail
*Assistant Examiner* — Shantese L McDonald

(57) ABSTRACT

A pneumatic jacking assembly for lifting a vehicle includes an air bag that is selectively inflated. A first plate is coupled to the air bag. The first plate is positioned on a support surface such that the first plate is positioned beneath a vehicle. A second plate is coupled to the air bag and the second plate abuts the vehicle when the air bag is inflated. In this way the air bag lifts the vehicle for servicing the vehicle. A pump is coupled to the first plate and the pump is in fluid communication with an interior of the air bag. The pump inflates the air bag when the pump is turned on. The second plate is urged away from the first plate when the air bag is inflated to lift the vehicle.

7 Claims, 4 Drawing Sheets

PNEUMATIC JACKING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to jacking devices and more particularly pertains to a new jacking device for lifting a vehicle.

(h) BRIEF SUMMARY OF THE INVENTION

An embodiment of the disclosure meets the needs presented above by generally comprising an air bag that is selectively inflated. A first plate is coupled to the air bag. The first plate is positioned on a support surface such that the first plate is positioned beneath a vehicle. A second plate is coupled to the air bag and the second plate abuts the vehicle when the air bag is inflated. In this way the air bag lifts the vehicle for servicing the vehicle. A pump is coupled to the first plate and the pump is in fluid communication with an interior of the air bag. The pump inflates the air bag when the pump is turned on. The second plate is urged away from the first plate when the air bag is inflated to lift the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
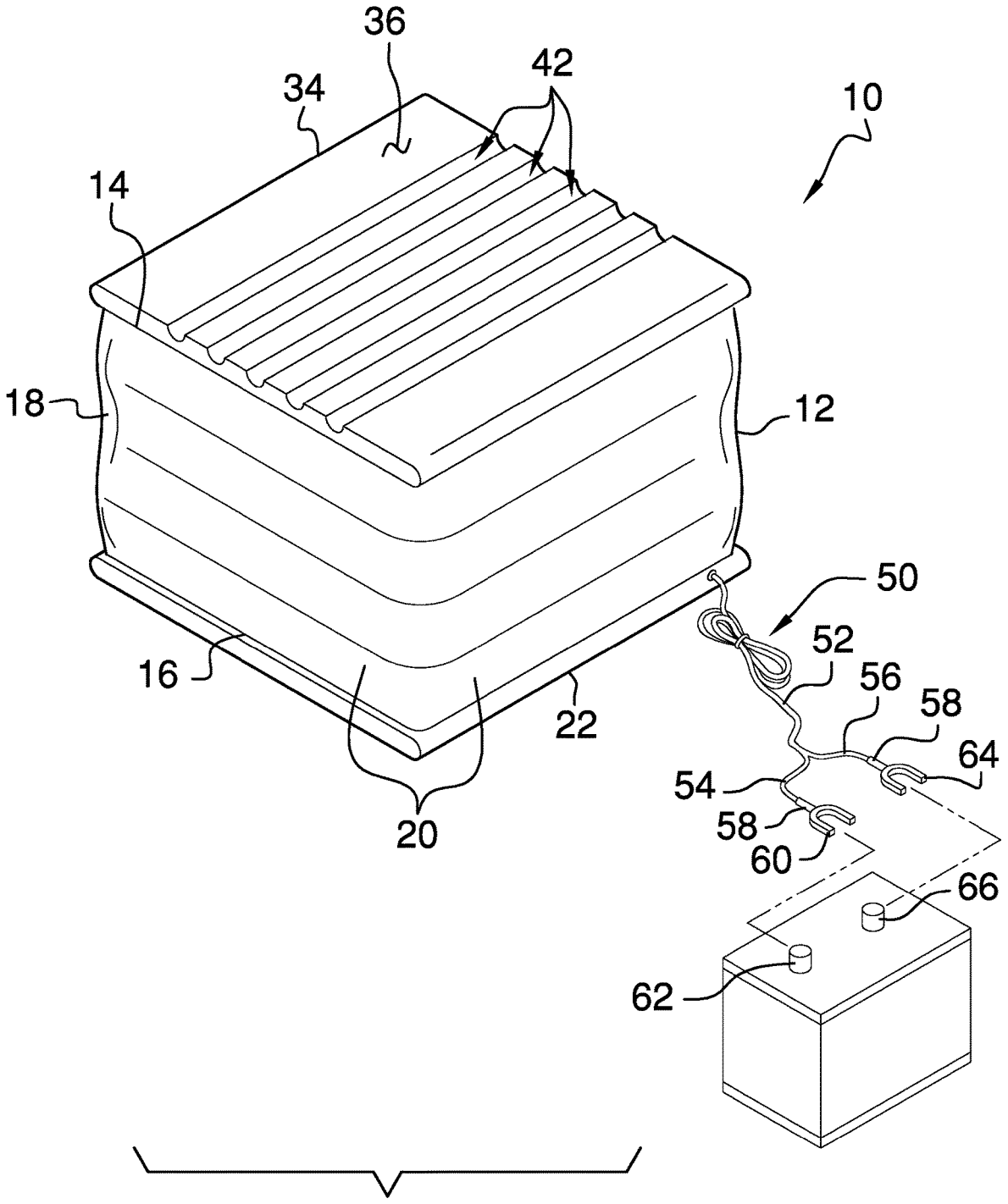
FIG. 1 is a perspective view of a pneumatic jacking assembly according to an embodiment of the disclosure.
Figure 2:
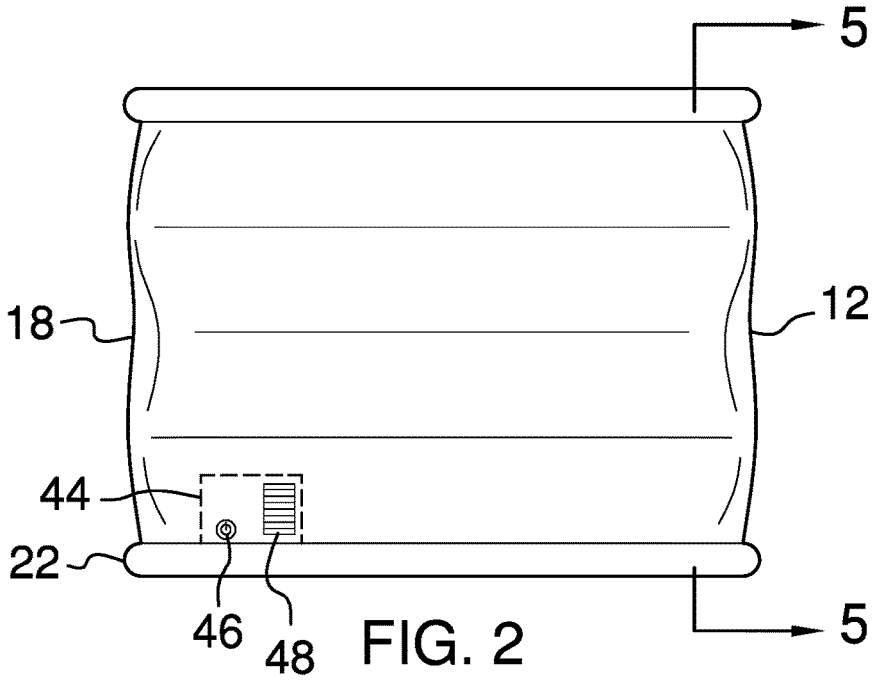
FIG. 2 is a back view of an embodiment of the disclosure.
Figure 3:
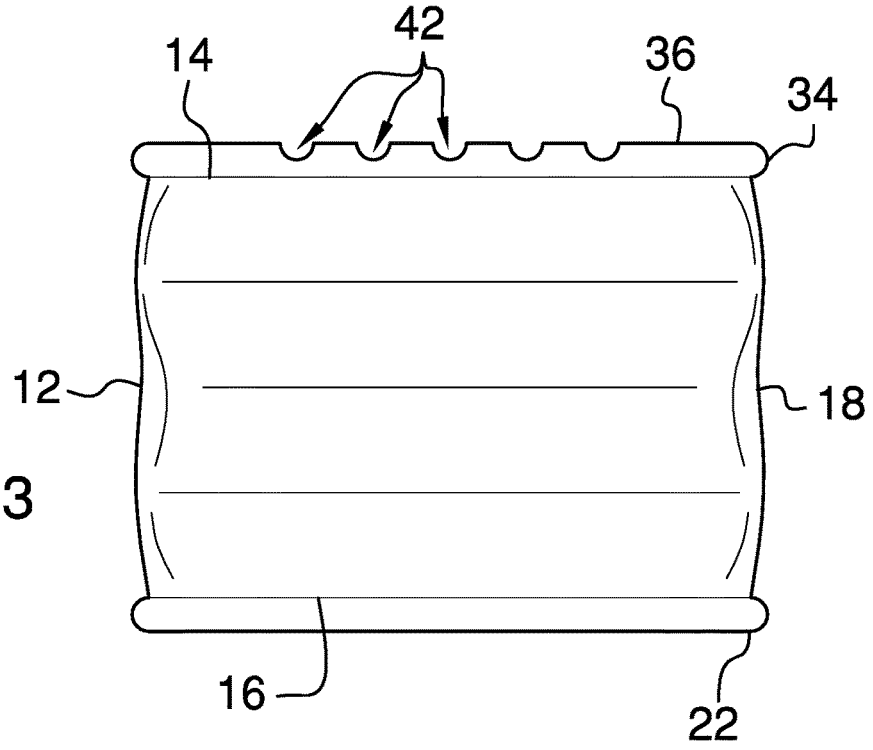
FIG. 3 is a right side view of an embodiment of the disclosure.
Figure 4:
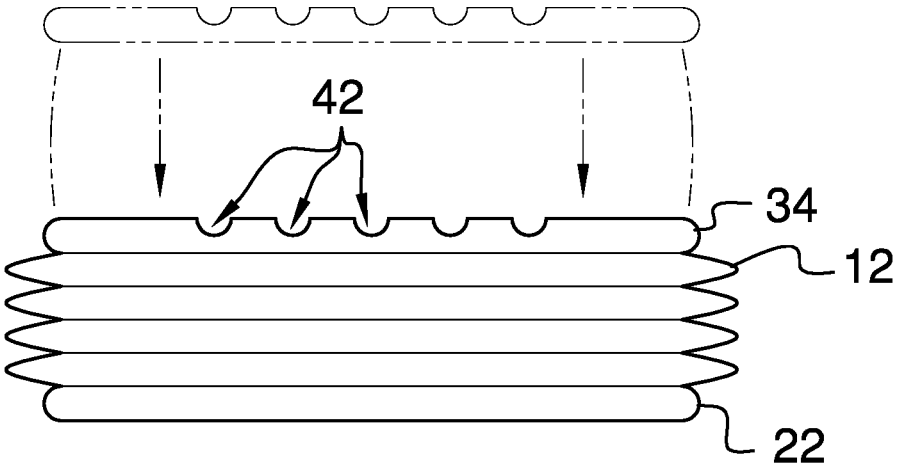
FIG. 4 is a front view of an embodiment of the disclosure showing an air bag being deflated.
Figure 5:
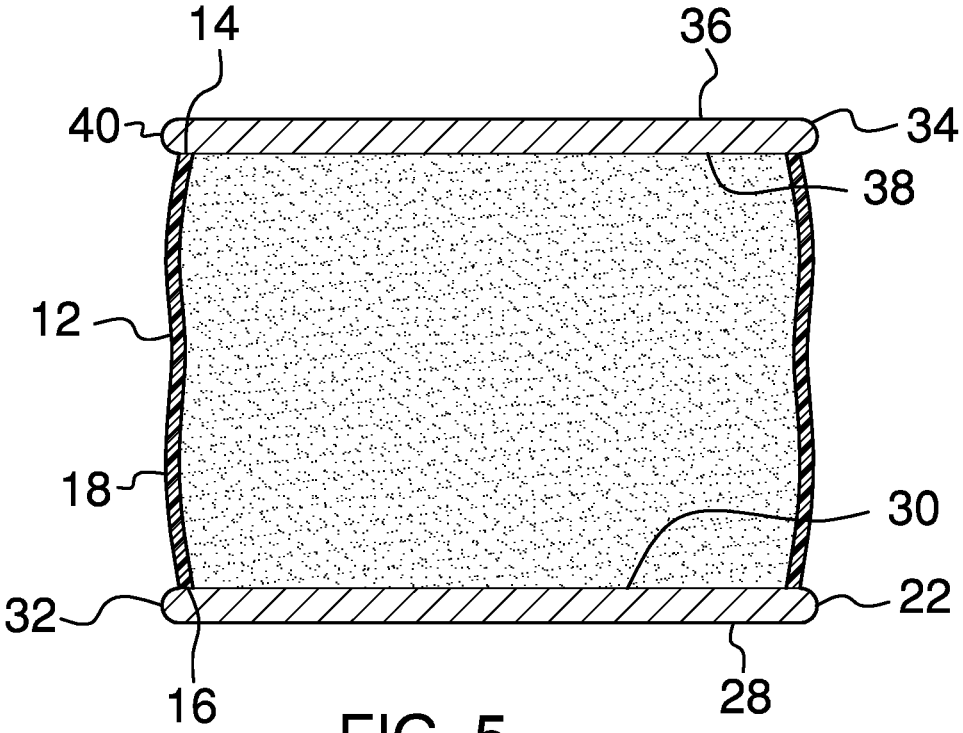
FIG. 5 is a cross sectional view taken along line 5-5 of FIG. 2 of an embodiment of the disclosure.
Figure 6:
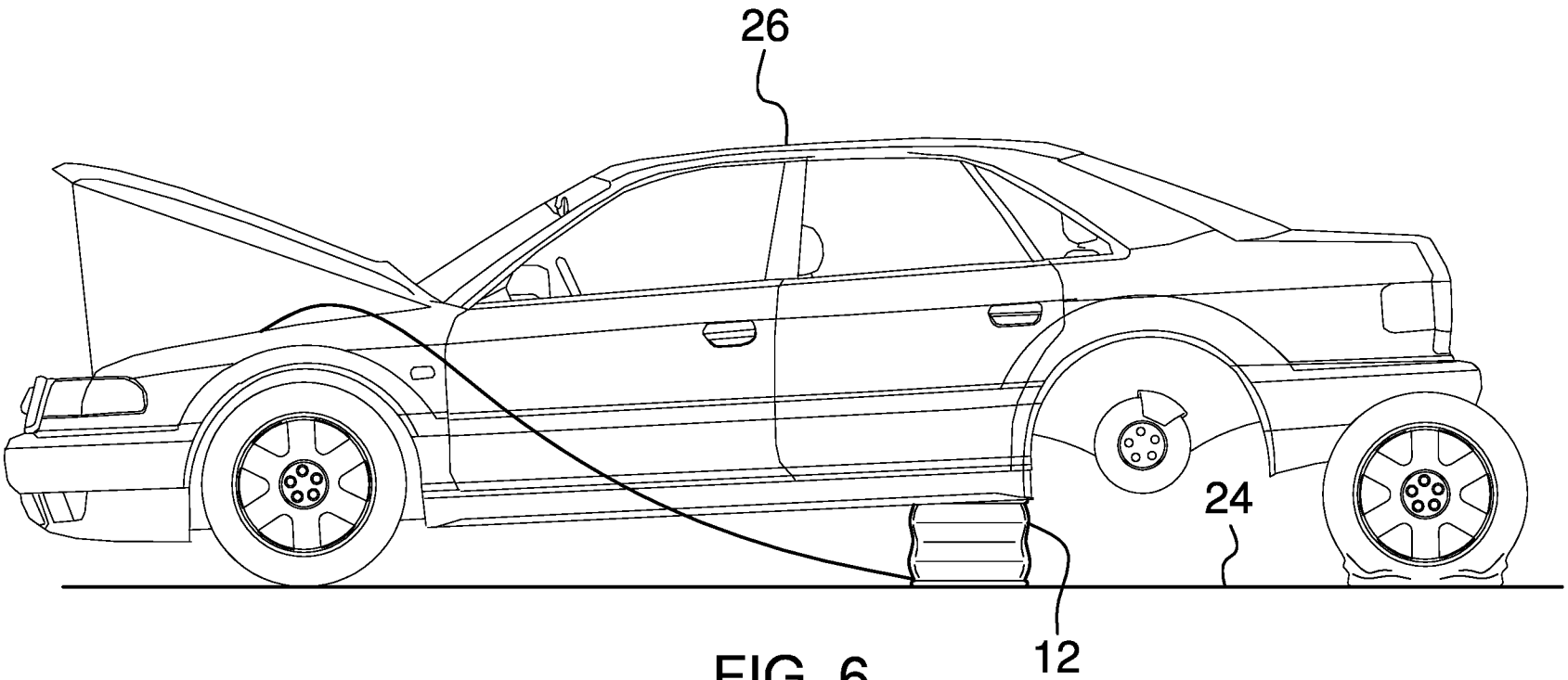
FIG. 6 is a perspective in-use view of an embodiment of the disclosure.

With reference now to the drawings, and in particular to FIGS. 1 through 6 thereof, a new jacking device embodying the principles and concepts of an embodiment of the disclosure and generally designated by the reference numeral 10 will be described.

As best illustrated in FIGS. 1 through 6, the pneumatic jacking assembly 48 10 generally comprises an air bag 12 that is selectively inflated. The air bag 12 has a top edge 14, a bottom edge 16 and an outer wall 18 extending therebetween. The outer wall 18 has a plurality of intersecting sides 20 such that the air bag 12 has a cubic shape. A first plate 22 is coupled to the air bag 12. The first plate 22 is selectively positioned on a support surface 24 such that the air bag 12 is positioned beneath a vehicle 26. The vehicle 26 may be a passenger vehicle 26 such as a car or the like.

The first plate 22 has a first surface 28, a second surface 30 and a perimeter edge 32 extending therebetween. The first surface 28 is positioned on the support surface 24. The bottom edge 16 of the air bag 12 is bonded to the second surface 30 of the first plate 22. Moreover, the bottom edge 16 forms a fluid impermeable seal with the second surface 30. The bottom edge 16 is coextensive with the perimeter edge 32 of the first plate 22 and the first plate 22 is comprised of a rigid material, such as steel or the like.

A second plate 34 is coupled to the air bag 12 and the second plate 34 abuts a bottom side of the vehicle 26 when the air bag 12 is inflated. In this way the air bag 12 lifts the vehicle 26 for servicing when the air bag 12 is inflated. The second plate 34 has a primary surface 36, a secondary surface 38 and a perimeter edge 40 extending therebetween. The top edge 14 of the air bag 12 is bonded to the secondary surface 38 such that the top edge 14 forms a fluid impermeable seal with the secondary surface 38. The top edge 14 is coextensive with the perimeter edge 32 of the second plate 34 and the second plate 34 is comprised of a rigid material, such as steel or the like. The bond between the air bag 12 and each of the first 22 and second 34 plates may be accomplished through any conventional mechanical and chemical means.

The primary surface 36 has a plurality of grooves 42 to frictionally engage the vehicle 26. In this way the grooves 42 inhibit the vehicle 26 from sliding on the primary surface 36. Each of the grooves 42 extends between opposite sides of the perimeter edge 40 of the second plate 34. Moreover, the grooves 42 are spaced apart from each other and are distributed along the primary surface 36.

A pump 44 is coupled to the first plate 22 and the pump 44 is in fluid communication with an interior of the air bag 12. The pump 44 inflates the air bag 12 when the pump 44 is turned on. The second plate 34 is urged away from the first plate 22 when the air bag 12 is inflated. In this way the second plate 34 lifts the vehicle 26. The pump 44 may be an electric air pump or the like. The pump 44 may be positioned on the second surface 30 of the first plate 22. Additionally, the pump 44 may extend through the outer wall 18 of the air bag 12 to access the pump 44. The pump 44 may have an operational output ranging between approximately 50.0 psi and 100.0 psi. Additionally, the air bag 12 may have a pressure rating that is equal to or greater than the operational output of the pump 44.

A button 46 is coupled to the pump 44 and the button 46 is selectively manipulated. The button 46 is electrically coupled to the pump 44 to turn the pump 44 on and off. A vent 48 is coupled to the outer wall 18 of the air bag 12 and the vent 48 is selectively manipulated. The vent 48 is in fluid communication with the interior of the air bag 12 to pass air outwardly from the air bag 12. The vent 48 deflates the air bag 12 when the vent 48 is opened. The vent 48 may be an air valve or the like.

A power supply 50 is electrically coupled to the pump 44. The power supply 50 comprises a power cord 52 extending away from the first plate 22. The power cord 52 has a negative line 54 and a positive line 56. Each of the negative line 54 and the positive line 56 has a distal end 58 with respect to the pump 44.

A first connector 60 is electrically coupled to the distal end 58 of the negative line 54. The first connector 60 is selectively electrically coupled to a negative battery terminal 62. A second connector 64 is electrically coupled to the distal end 58 of the positive line 56. The second connector 64 is selectively electrically coupled to a positive battery terminal 66. Each of the first 60 and second 64 connectors may be spade terminals or the like. Alternatively, the power cord 52 may have a cigarette adapter for plugging into a cigarette lighter in the vehicle 26. The power cord 52 may have a length of at least 10.0 feet thereby facilitating the power cord 52 to reach between a rear tire of the vehicle 12 and a battery of the vehicle 12.

In use, the first plate 22 is positioned on the ground such that the second plate 34 is aligned with a selected spot on the bottom of the vehicle 26. Generally speaking, the second plate 34 will be aligned with an approved jacking point on the bottom of the vehicle 26. Each of the negative 54 and positive 56 lines is electrically coupled to the associated negative 62 and positive 66 battery terminals. The button 46 is manipulated and the pump 44 inflates the air bag 12. Thus, the second plate 34 is urged upwardly from the first plate 22 until the second plate 34 lifts the vehicle 26 from the ground. In this way a tire on the vehicle 26 may be changed and other service actions may be performed. The vent 48 is manipulated to deflate the air bag 12 and subsequently lower the vehicle 26 to the ground.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pneumatic jacking assembly being configured to selectively lift a vehicle, said assembly comprising:

an air bag being configured to be selectively inflated, said air bag having a top edge, a bottom edge and an outer wall extending therebetween, said outer wall having a plurality of intersecting sides such that said air bag has a cubic shape;

a first plate being coupled to said air bag, said first plate being configured to be positioned on a support surface such that said first plate is positioned beneath a vehicle;

a second plate being coupled to said air bag wherein said second plate is configured to abut the vehicle when said air bag is inflated thereby facilitating said air bag to lift the vehicle for servicing the vehicle, said second plate having a primary surface, a secondary surface and a perimeter edge extending therebewteen, said top edge of said air bag being bonded to said secondary surface such that said top edge forms a fluid impermeable seal with said secondary surface, said top edge being coextensive with said perimeter edge of said second plate, said primary surface having a plurality of grooves wherein each of said grooves is configured to frictionally engage the vehicle thereby inhibiting the vehicle from sliding on said primary surface, each of said grooves being linear and extending perpendicularly between opposite sides of said perimeter edge of said second plate, said grooves being spaced apart from each other and being distributed along said primary surface;

a pump being coupled to said first plate, said pump being in fluid communication with an interior of said air bag, said pump inflating said air bag when said pump is turned on, said second plate being urged away from said first plate when said air bag is inflated wherein said second plate is configured to lift the vehicle; and a power supply being electrically coupled to said pump, said power supply comprising a power cord extending away from said first plate, said power cord having a negative line and a positive line, each of said negative line and said positive line having a distal end with respect to said pump.

2. The assembly according to claim 1, wherein said first plate has a first surface, a second surface and a perimeter edge extending therebetween, said first surface being configured to be positioned on the support surface, said bottom edge of said air bag being bonded to said second surface of said first plate such that said bottom edge forms a fluid impermeable seal with said second surface, said bottom edge being coextensive with said perimeter edge of said first plate.

3. The assembly according to claim 1, further comprising a button being coupled to said pump wherein said button is configured to be manipulated, said button being electrically coupled to said pump such that said button turns said pump on and off.

4. The assembly according to claim 1, further comprising a vent being coupled to said outer wall of said air bag wherein said vent is configured to be manipulated, said vent being in fluid communication with said interior of said air bag wherein said vent is configured to pass air outwardly from said air bag, said vent deflating said air bag when said vent is opened.

5. The assembly according to claim 1, wherein said distal end of said negative line has a first connector being electrically coupled thereto, said first connector being configured to be electrically coupled to a negative battery terminal.

6. The assembly according to claim 1, wherein said distal end of said positive line has a second connector being electrically coupled thereto, said second connector being configured to be electrically coupled to a positive battery terminal.

7. A pneumatic jacking assembly being configured to selectively lift a vehicle, said assembly comprising:

a air bag being configured to be selectively inflated, said air bag having a top edge, a bottom edge and an outer wall extending therebetween, said outer wall having a plurality of intersecting sides such that said air bag has a cubic shape;

a first plate being coupled to said air bag, said first plate being configured to be positioned on a support surface such that said first plate is positioned beneath a vehicle, said first plate having a first surface, a second surface and a perimeter edge extending therebetween, said first surface being configured to be positioned on the support surface, said bottom edge of said air bag being bonded to said second surface of said first plate such that said bottom edge forms a fluid impermeable seal with said second surface, said bottom edge being coextensive with said perimeter edge of said first plate, said first plate being comprised of a rigid material;

a second plate being coupled to said air bag wherein said second plate is configured to abut the vehicle when said air bag is inflated thereby facilitating said air bag to lift the vehicle for servicing the vehicle, said second plate having a primary surface, a secondary surface and a perimeter edge extending therebewteen, said top edge of said air bag being bonded to said secondary surface such that said top edge forms a fluid impermeable seal with said secondary surface, said top edge being coextensive with said perimeter edge of said second plate, said primary surface having a plurality of grooves wherein each of said grooves is configured to frictionally engage the vehicle thereby inhibiting the vehicle from sliding on said primary surface, each of said grooves being linear and extending perpendicularly between opposite sides of said perimeter edge of said second plate, said second plate being comprised of a rigid material;

a pump being coupled to said first plate, said pump being in fluid communication with an interior of said air bag, said pump inflating said air bag when said pump is turned on, said second plate being urged away from said first plate when said air bag is inflated wherein said second plate is configured to lift the vehicle;

a button being coupled to said pump wherein said button is configured to be manipulated, said button being electrically coupled to said pump such that said button turns said pump on and off;

a vent being coupled to said outer wall of said air bag wherein said vent is configured to be manipulated, said vent being in fluid communication with said interior of said air bag wherein said vent is configured to pass air outwardly from said air bag, said vent deflating said air bag when said vent is opened; and a power supply being electrically coupled to said pump, said power supply comprising a power cord extending away from said first plate, said power cord a negative line and a positive line, each of said negative line and said positive line having a distal end with respect to said pump, said distal end of said negative line having a first connector being electrically coupled thereto, said first connector being configured to be electrically coupled to a negative battery terminal, said distal end of said positive line having a second connector being electrically coupled thereto, said second connector being configured to be electrically coupled to a positive battery terminal.

* * * * *